US010024171B2

(12) United States Patent
Itzel

(10) Patent No.: US 10,024,171 B2
(45) Date of Patent: Jul. 17, 2018

(54) ARTICLE AND METHOD OF COOLING AN ARTICLE

(71) Applicant: GENERAL ELECTRIC COMPANY, Schenectady, NY (US)

(72) Inventor: Gary Michael Itzel, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 357 days.

(21) Appl. No.: 14/963,733

(22) Filed: Dec. 9, 2015

(65) Prior Publication Data

US 2017/0167269 A1 Jun. 15, 2017

(51) Int. Cl.

| | |
|---|---|
| ***F01D 5/18*** | (2006.01) |
| ***F01D 9/06*** | (2006.01) |
| ***F01D 25/12*** | (2006.01) |
| ***F01D 9/04*** | (2006.01) |

(52) U.S. Cl.

CPC ..... *F01D 5/187* (2013.01); *F01D 9/065* (2013.01); *F01D 9/041* (2013.01); *F01D 25/12* (2013.01); *F05D 2220/32* (2013.01); *F05D 2260/201* (2013.01); *F05D 2260/205* (2013.01)

(58) Field of Classification Search

CPC ..... F01D 5/187; F01D 9/065; F01D 9/041; F01D 25/12; F01D 5/188; F05D 2220/32; F05D 2260/201; F05D 2260/205; F05D 2260/202

See application file for complete search history.

(56) References Cited

U.S. PATENT DOCUMENTS

| | | | | |
|---|---|---|---|---|
| 4,056,332 A * | 11/1977 | Meloni | F01D 5/188 415/115 |
| 4,252,501 A | 2/1981 | Peill | |
| 5,120,192 A * | 6/1992 | Ohtomo | F01D 5/189 415/115 |
| 5,813,836 A * | 9/1998 | Starkweather | F01D 5/187 415/173.4 |
| 6,036,441 A | 3/2000 | Manning et al. | |
| 6,773,230 B2 | 8/2004 | Bather et al. | |
| 7,497,655 B1 | 3/2009 | Liang | |
| 7,556,476 B1 * | 7/2009 | Liang | F01D 5/188 415/115 |

(Continued)

*Primary Examiner* — Logan Kraft
*Assistant Examiner* — Eric Zamora Alvarez
(74) *Attorney, Agent, or Firm* — McNees Wallace & Nurick LLC

(57) ABSTRACT

An article and method of cooling an article are provided. The article includes a body portion, a plurality of partitions within the body portion, and at least one aperture in each of the partitions, the at least one aperture arranged and disposed to direct fluid towards an inner surface of the body portion. The plurality of partitions form at least one up-pass cavity and at least one re-use cavity arranged and disposed to receive the fluid from the at least one aperture in one of the partitions. The method includes providing the article having an up-pass partition and a re-use partition, generating a first fluid flow through the at least one aperture in the up-pass partition, receiving a post-impingement fluid within the re-use cavity, and generating a re-use fluid flow through the at least one aperture in the re-use partition, the re-use fluid flow being generated from the post-impingement fluid.

15 Claims, 5 Drawing Sheets

(56) References Cited

U.S. PATENT DOCUMENTS

| | | | | |
|---|---|---|---|---|
| 8,070,442 | B1 | 12/2011 | Liang | |
| 8,596,976 | B2 * | 12/2013 | Hada | F01D 5/189 415/115 |
| 2009/0074575 | A1 * | 3/2009 | Propheter-Hinckley | F01D 5/186 416/95 |
| 2014/0219788 | A1 | 8/2014 | Nilsson | |

* cited by examiner

ARTICLE AND METHOD OF COOLING AN ARTICLE

FIELD OF THE INVENTION

The present invention is directed to an article and a method of cooling an article. More particularly, the present invention is directed to a cooled article and a method of cooling a cooled article.

BACKGROUND OF THE INVENTION

Turbine systems are continuously being modified to increase efficiency and decrease cost. One method for increasing the efficiency of a turbine system includes increasing the operating temperature of the turbine system. To increase the temperature, the turbine system must be constructed of materials which can withstand such temperatures during continued use.

In addition to modifying component materials and coatings, one common method of increasing temperature capability of a turbine component includes the use of cooling features. For example, many turbine components include impingement sleeves or impingement plates positioned within an internal cavity thereof. The impingement sleeves or plates include a plurality of cooling channels that direct a cooling fluid towards an inner surface of the turbine component, providing impingement cooling of the turbine component. However, forming separate individual impingement sleeves for positioning within the turbine components increases manufacturing time and cost. Additionally, impingement sleeves typically generate significant cross flow between the impingement sleeve and the turbine component, and require sufficient cooling fluid to provide fluid flow through each of the cooling channels at one time, both of which decrease efficiency of the system.

Another method of cooling turbine components includes the use of serpentine cooling. Serpentine cooling includes passing a cooling fluid through a passage within the turbine component to simultaneously cool both the pressure and suction side walls of the component. The simultaneous cooling of both walls may overcool one wall in order to sufficiently cool the other. The overcooling of one wall leads to thermal gradients as well as unnecessary heat pickup, both of which decrease downstream cooling effectiveness and cooling efficiency.

BRIEF DESCRIPTION OF THE INVENTION

In an embodiment, an article includes a body portion having an inner surface and an outer surface, the inner surface defining an inner region, a plurality of partitions within the body portion, each of the partitions extending across the inner region, and at least one aperture in each of the plurality of partitions, the at least one aperture arranged and disposed to direct fluid towards the inner surface of the body portion. The plurality of partitions form at least one up-pass cavity and at least one re-use cavity, the at least one re-use cavity being arranged and disposed to receive the fluid from the at least one aperture in one of the partitions.

In another embodiment, an article includes a body portion having an inner surface and an outer surface, the inner surface defining an inner region, a plurality of integral partitions each extending across the inner region from a pressure side wall to a section side wall of the article, the integral partitions forming an up-pass cavity and at least one re-use cavity within the inner region, and at least one aperture formed in each of the integral partitions, the at least one aperture arranged and disposed to direct fluid towards the inner surface of the body portion. The up-pass cavity is arranged and disposed to receive a fluid from outside the article and each of the at least one re-use cavities is arranged and disposed to receive a post-impingement fluid from the at least one aperture in one of the partitions.

In another embodiment, a method of cooling an article includes providing the article comprising a body portion having an inner surface and an outer surface, the inner surface defining an inner region, an up-pass partition extending across the inner region, the up-pass partition forming an up-pass cavity within the inner region, a re-use partition extending across the inner region, the re-use partition forming a re-use cavity within the inner region, and at least one aperture formed in each of the up-pass partition and the re-use partition, the at least one aperture arranged and disposed to direct fluid towards the inner surface of the body portion, directing a fluid into the up-pass cavity, generating a first fluid flow through the at least one aperture in the up-pass partition, contacting the inner surface of the body portion with the first fluid flow, the contacting of the inner surface cooling the inner surface and forming a first post-impingement fluid, receiving the first post-impingement fluid within the re-use cavity, generating a re-use fluid flow through the at least one aperture in the re-use partition, and contacting the inner surface of the body portion with the re-use fluid flow, the contacting of the inner surface cooling the inner surface and forming a re-use post-impingement fluid. The re-use fluid flow is generated from the first post-impingement fluid received within the at least one re-use cavity.

Other features and advantages of the present invention will be apparent from the following more detailed description, taken in conjunction with the accompanying drawings which illustrate, by way of example, the principles of the invention.

BRIEF DESCRIPTION OF THE DRAWINGS

Wherever possible, the same reference numbers will be used throughout the drawings to represent the same parts.

DETAILED DESCRIPTION OF THE INVENTION

Provided are an article and method of cooling an article. Embodiments of the present disclosure, for example, in comparison to concepts failing to include one or more of the features disclosed herein, decrease overcooling of articles, decrease temperature increases of cooling fluid due to overcooling of articles, increase cooling efficiency, decrease thermal gradient formation, increase downstream cooling effectiveness, facilitate reuse of cooling fluid, facilitate increased control of cooling flow distribution, provide increased stability of article temperatures, reduce cross flow, reduce cross flow degradation, increase article life, facilitate use of increased system temperatures, increase system efficiency, provide increased control over film supply pressure, or a combination thereof.

Figure 1:
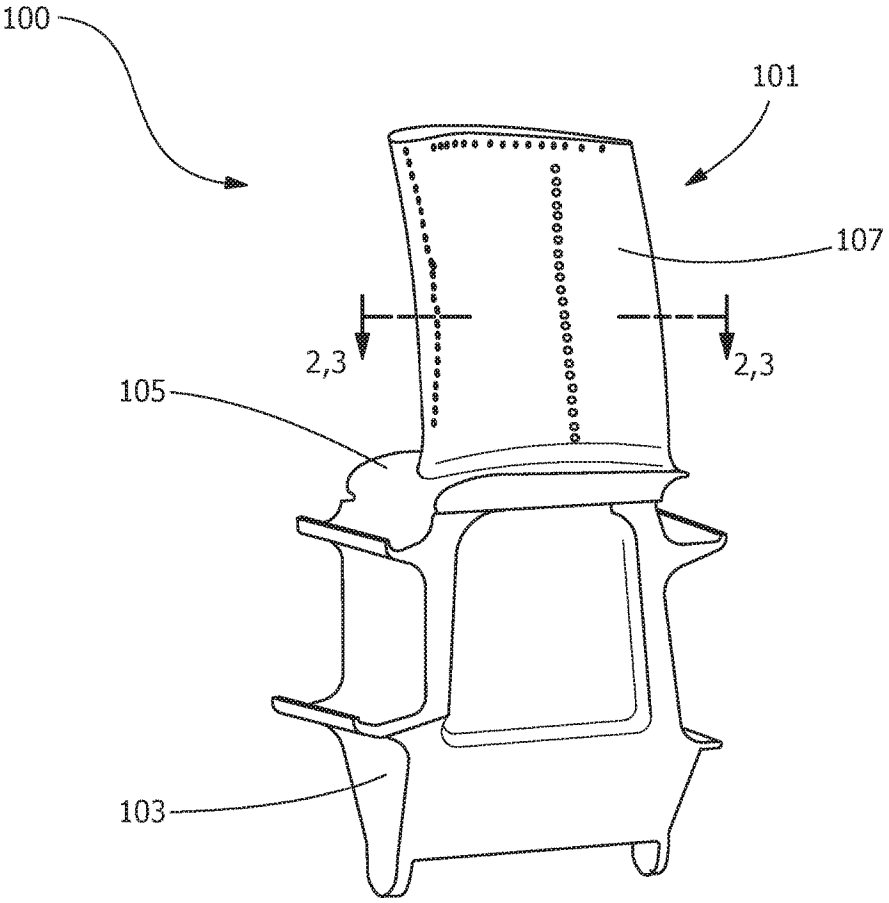
FIG. 1 is a front perspective view of an article, according to an embodiment of the disclosure.

Referring to FIG. 1, in one embodiment, an article 100 includes, but is not limited to, a turbine bucket 101 or blade. The turbine bucket 101 has a root portion 103, a platform 105, and an airfoil portion 107. The root portion 103 is configured to secure the turbine bucket 101 within a turbine system, such as, for example, to a rotor wheel. Additionally, the root portion 103 is configured to receive a fluid from the turbine system and direct the fluid into the airfoil portion 107. Although described herein with regard to a turbine bucket, as will be appreciated by those skilled in the art, the article 100 is not so limited and may include any other article suitable for receiving a cooling fluid, such as, for example, a hollow component, a hot gas path component, a shroud, a nozzle, a vane, or a combination thereof.

Figure 2:
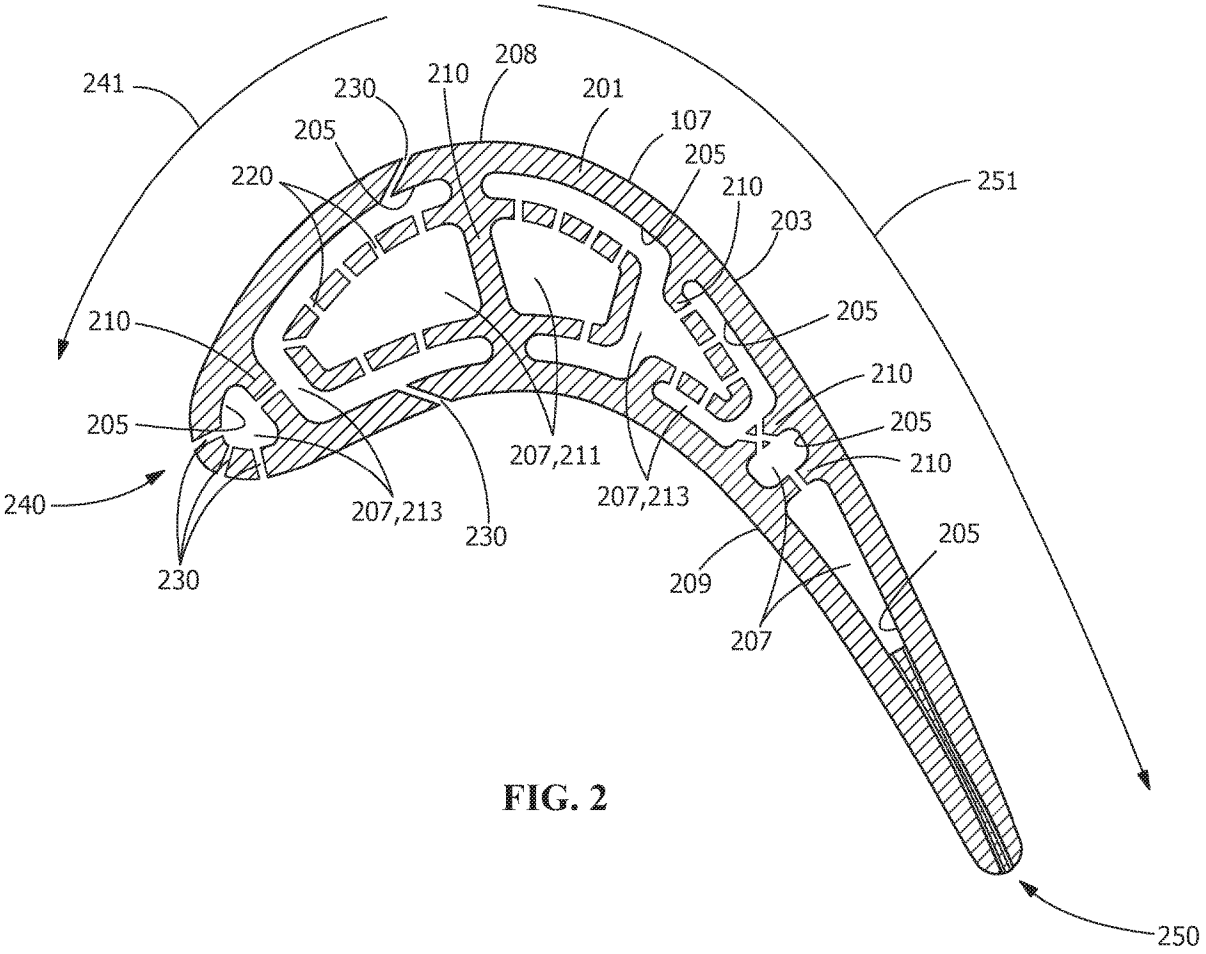
FIG. 2 is a section view of the article of FIG. 1, taken along the line 2-2, according to an embodiment of the disclosure.
Figure 3:
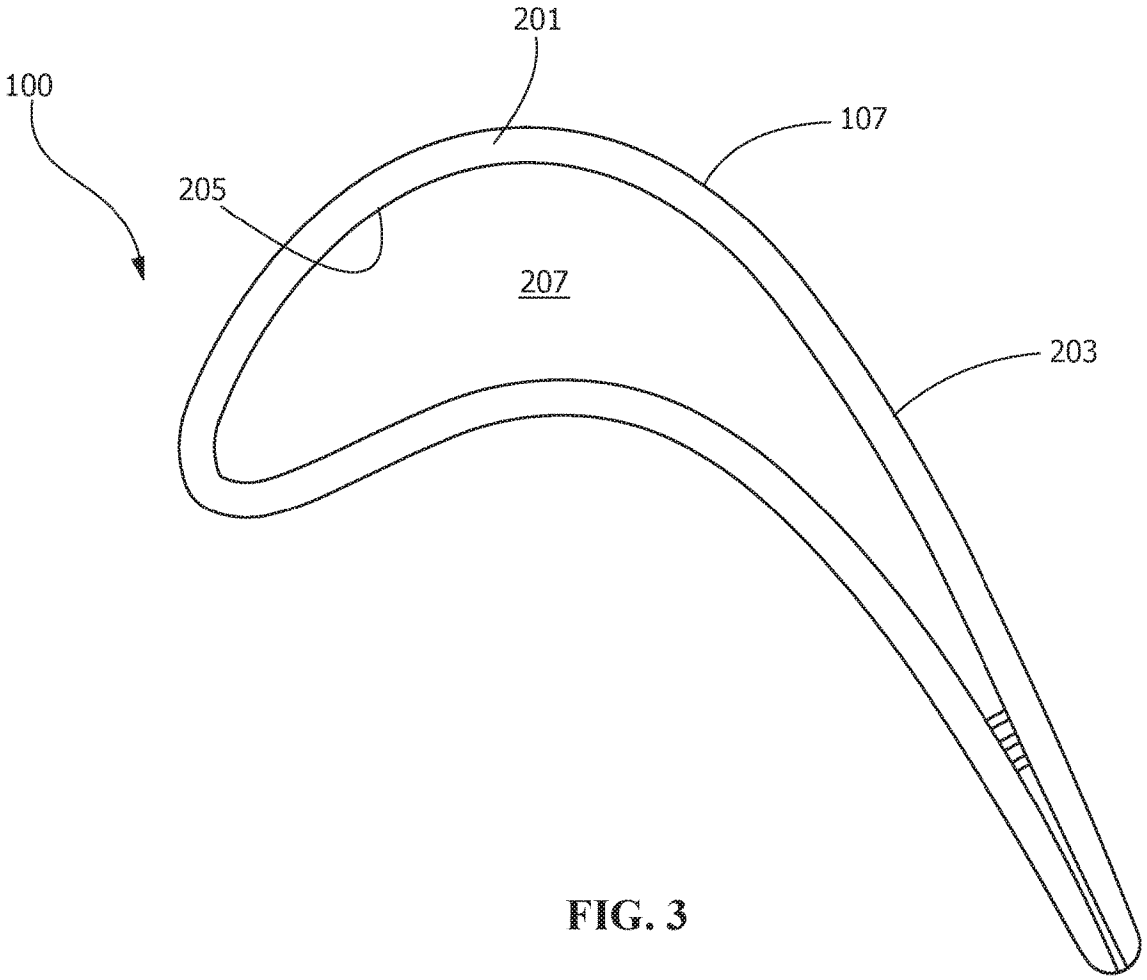
FIG. 3 shows the section view of FIG. 2 with the partitions removed.

As illustrated in FIG. 2, which shows a cross section of the airfoil portion 107, the article 100 includes a body portion 201 having an outer surface 203, an inner surface 205, and one or more partitions 210 formed therein. Each of the one or more partitions 210 extends across the inner region 207, from a first side of the article 100 to a second side of the article 100, and includes at least one aperture 220 formed therethrough. For example, in one embodiment, each of the partitions 210 extends from the inner surface 205 on a suction side 208 of the airfoil portion 107 to the inner surface 205 on a pressure side 209 of the airfoil portion 107. For the purpose of more clearly illustrating the inner surface 205 and an inner region 207 defined by the inner surface 205, FIG. 3 shows the airfoil portion 107 of FIG. 2 with the partitions 210 removed.

Returning to FIG. 2, the one or more partitions 210 may be formed integral with and/or separate from the body portion 201. In one embodiment, forming the one or more partitions 210 integral with the body portion 201 decreases or eliminates passage of fluid between the one or more partitions 210 and the body portion 201, as compared to the one or more partitions 210 formed separate from and then secured to the body portion 201. In another embodiment, the forming of the one or more partitions 210 integral with the body portion 201 decreases or eliminates leakage to post impingement, as compared to the one or more partitions 210 formed separate from and then secured to the body portion 201. Suitable methods for forming the body portion 201 and/or the one or more partitions 210 include, but are not limited to, direct metal laser melting (DMLM), direct metal laser sintering (DMLS), selective laser melting (SLM), selective laser sintering (SLS), fused deposition modeling (FDM), any other additive manufacturing technique, or a combination thereof.

The one or more partitions 210 form at least one up-pass cavity 211 and at least one re-use cavity 213. The at least one up-pass cavity 211 is positioned to receive a fluid from outside the article 100, such as, but not limited to, the fluid directed from the root portion 103 into the airfoil portion 107. Each of the re-use cavities 213 is configured to receive the fluid passing through the aperture(s) 220 in the one or more partitions 210, such as, but not limited to, the fluid passing through the aperture(s) 220 in the partition 210 forming the up-pass cavity 211 and/or any other re-use cavity 213 between the up-pass cavity 211 and the re-use cavity 213. For example, as illustrated in FIG. 2, the fluid from outside the article 100 passes sequentially from the at least one up-pass cavity 211 through each of the one or more re-use cavities 213 formed between the at least one up-pass cavity 211 and a leading edge 240 and/or trailing edge 250 of the article 100.

In one embodiment, the article 100 includes two of the up-pass cavities 211 formed by one of the partitions 210 within the inner region 207. In another embodiment, one of the up-pass cavities 211 extends towards the leading edge 240 and the other up-pass cavity 211 extends towards the trailing edge 250. The up-pass cavity 211 extending towards the leading edge 240, as well as any re-use cavities 213 formed between the up-pass cavity 211 and the leading edge 240, define a leading edge pathway 241. The up-pass cavity 211 extending towards the trailing edge 250, as well as any re-use cavities 213 formed between the up-pass cavity 211 and the trailing edge 250, define a trailing edge pathway 251.

Figure 4:
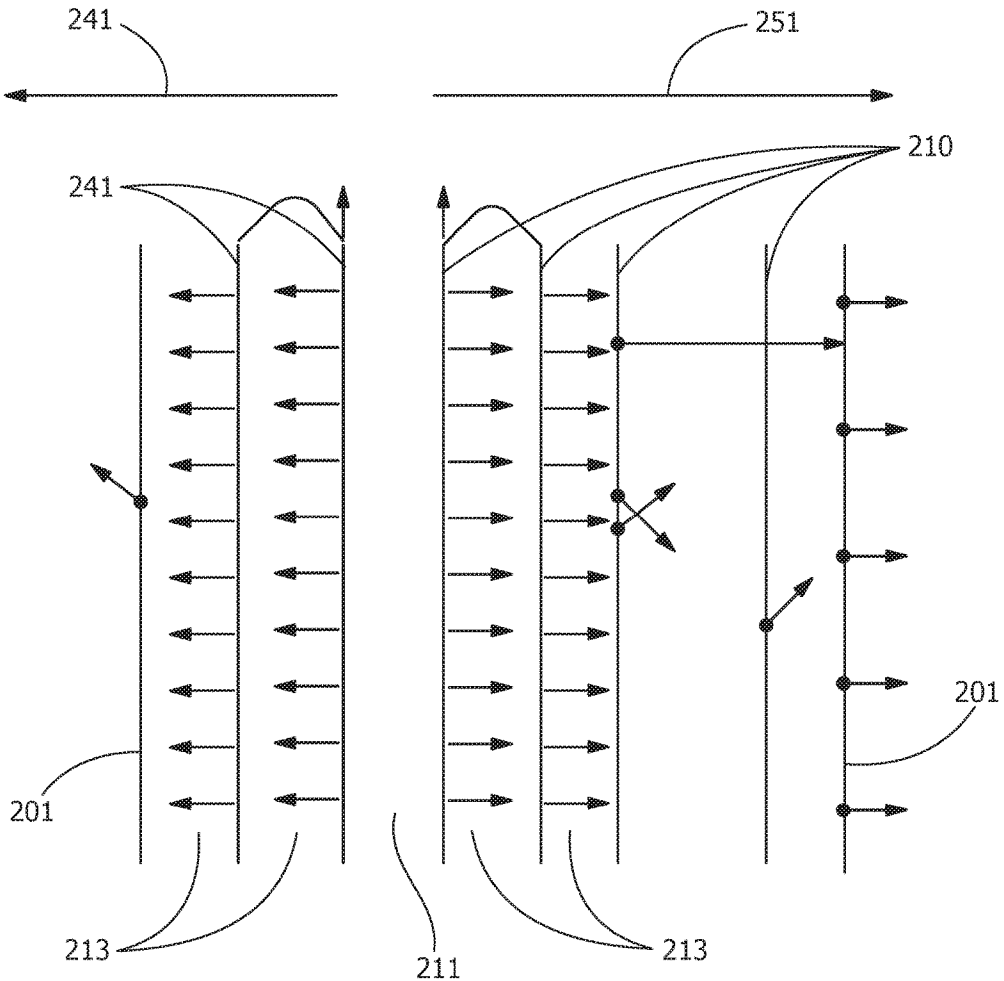
FIG. 4 is a schematic view of a flow profile within the article of FIG. 2, according to an embodiment of the disclosure.
Figure 5:
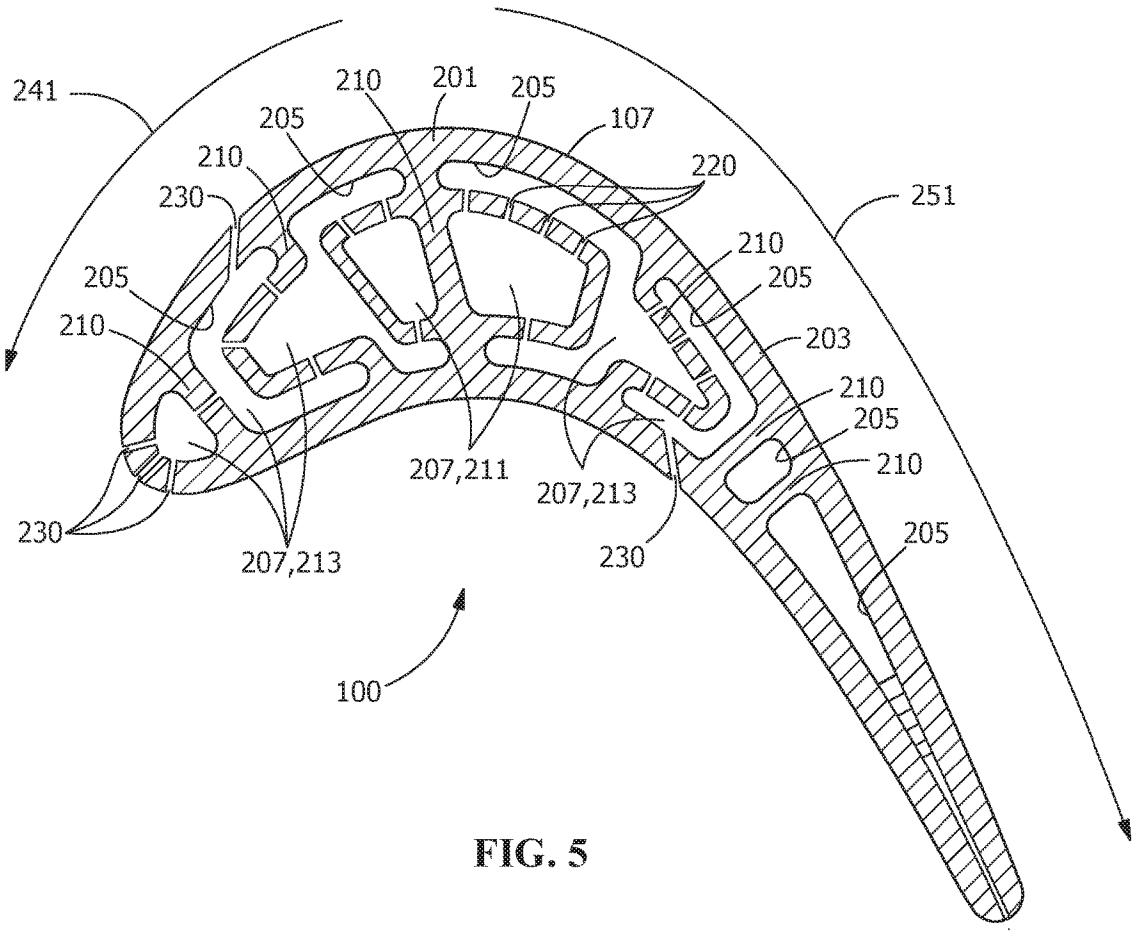
FIG. 5 is a section view of the article of FIG. 1, taken along the line 2-2, according to an alternate embodiment of the disclosure.

The leading edge pathway 241 and the trailing edge pathway 251 each include any suitable number of the re-use cavities 213. For example, as illustrated in FIGS. 2 and 4, both the leading edge pathway 241 and the trailing edge pathway 251 include two of the re-use cavities 213. In another example, as illustrated in FIG. 5, the leading edge pathway 241 includes three of the re-use cavities 213 and the trailing edge pathway 251 includes two of the re-use cavities 213. As will be appreciated by those skilled in the art, the article 100 is not limited to the examples above, and may include any other suitable number of up-pass cavities 211 and/or re-use cavities 213, with the leading edge pathway 241 and the trailing edge pathway 251 having the same or a different number of cavities.

Referring to FIGS. 2, 4, and 5, the at least one aperture 220 formed in each of the one or more partitions 210 provides fluid flow therethrough. In one embodiment, the at least one aperture 220 in the partition 210 forming the up-pass cavity 211 provides fluid flow from the up-pass cavity 211 to one or more of the re-use cavities 213. In another embodiment, the at least one aperture 220 in the partition 210 forming each of the re-use cavities 213 provides fluid flow from the re-use cavity 213 to one or more other re-use cavities 213. In a further embodiment, the body portion 201 includes one or more openings 230 formed therein, each of the openings 230 configured to direct the fluid from one of the up-pass cavities 211 and/or one of the re-use cavities 213 to the outer surface 203.

In addition to providing fluid flow therethrough, one or more of the apertures 220 in each of the partitions 210 is configured to direct the fluid towards the inner surface 205 of the body portion 201. For example, each of the apertures 220 may be configured to generate an impingement fluid flow directed towards the inner surface 205. Additionally or alternatively, each of the one or more openings 230 is configured to generate a film flow from the fluid passing therethrough. Suitable shapes and/or geometries of the one or more apertures 220 and/or the one or more openings 230 include, but are not limited to, straight, curved, circular, substantially circular, semi-circular, chevron-shaped, square, triangular, star shaped, irregular, or a combination thereof.

In one embodiment, the aperture(s) 220 are configured to provide a desired wall temperature distribution. For example, the partition 210 may include a comparatively increased number of the apertures 220 directed towards either the suction side 208 or the pressure side 209, the comparatively increased number of apertures 220 directed towards one side providing an increased cooling of that side. Additionally or alternatively, an increased number of the apertures 220 may be formed in one of the partitions 210 as compared to another partition 210, the partition 210 including the increased number of apertures 220 providing increased cooling of a corresponding portion of the article 100. The desired wall temperature provided by the configuration of the aperture(s) 220 decreases overcooling of the article 100, increases downstream cooling efficiency, increases system performance, decreases unnecessary heat pickup in the fluid prior to the formation of the film cooling flow by not overcooling regions of the component, increases article life, decreases fluctuations in wall temperatures, increases uniformity of wall temperatures, or a combination thereof.

In certain embodiments, each of the re-use cavities 213 is configured to receive post-impingement fluid from the aperture(s) 220 in the partition 210 forming the up-pass cavity 211 and/or the re-use cavity 213. As used herein, "post-impingement fluid" refers to fluid directed towards the inner surface 205 of the body portion 201, and includes both the fluid that contacts, or impinges upon, the inner surface 205, as well as the fluid that is directed through the one or more apertures 220 but does not contact the inner surface 205. For example, the two re-use cavities 213 of the airfoil portion 107 illustrated in FIG. 2 may form a first re-use cavity and a second re-use cavity. The first re-use cavity, which is between the up-pass cavity 211 and the second re-use cavity, is configured to receive post-impingement fluid from the impingement fluid flow generated through the aperture(s) 220 of the up-pass cavity 211. The second re-use cavity, which is positioned between the first re-use cavity and the leading edge 240 of the airfoil portion 107, is configured to receive post-impingement fluid from the impingement fluid flow generated through the aperture(s) 220 of the first re-use cavity. The article 100 may also include one or more additional re-use cavities, each of the additional re-use cavities being configured to receive post-impingement fluid from the aperture(s) 220 in the partition 210 forming any upstream cavity, including, but not limited to, the up-pass cavity 211 and/or any of the re-use cavities 213 positioned between the up-pass cavity 211 and the additional re-use cavity.

According to one or more of the embodiments disclosed herein, the impingement cooling flow generated through the aperture(s) 220 in the partition 210 of each re-use cavity 213 consists of or consists essentially of the post-impingement fluid received by the re-use cavity 213. For example, in the leading edge pathway 241 of the article illustrated in FIGS. 2, 4, and 5, the first re-use cavity is configured to generate the impingement cooling flow through the aperture(s) 220 thereof consisting of or consisting essentially of the post-impingement fluid received from the up-pass cavity 211. The second re-use cavity is configured to generate the film cooling flow through the opening(s) 230 thereof (see FIGS. 2, 4, and 5) and/or generate the impingement cooling flow through the aperture(s) 220 thereof (see FIG. 5) consisting of or consisting essentially of the post-impingement fluid from the first re-use cavity. As used herein, the term "consisting essentially of" refers to the impingement cooling flow composed of at least 90% post-impingement fluid.

By generating impingement cooling flow consisting of or consisting essentially of post-impingement fluid, the re-use cavities 213 provide series impingement cooling of the article 100. The series impingement cooling of the article 100 includes one or more flow paths fed substantially or entirely through the fluid received by the at least one up-pass cavity 211, which increases cooling efficiency of the article 100, decreases an amount of fluid directed to the article 100, decreases post-impingement fluid flow, decreases cross-flow degradation, improves film cooling efficiency by providing increased control over film hole pressure ratio, and/or providing increased control over the film row blowing ratio.

While the invention has been described with reference to one or more embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims. In addition, all numerical values identified in the detailed description shall be interpreted as though the precise and approximate values are both expressly identified.

What is claimed is:

1. An article, comprising:

a body portion having an inner surface and an outer surface, the inner surface defining an inner region;

a plurality of partitions within the body portion, each of the partitions extending across the inner region; and a plurality of apertures in each of the plurality of partitions, the plurality of apertures arranged and disposed to direct fluid towards the inner surface of the body portion;

wherein the plurality of partitions includes:

an up-pass partition defining at least one up-pass cavity; and at least one re-use partition defining at least a first re-use cavity and at least one additional re-use cavity, wherein the first re-use cavity is arranged and disposed to receive the fluid as an impingement fluid flow through the plurality of apertures from the up-pass cavity such that the impingement fluid flow impingement cools a suction side and a pressure side of the inner surface along the first re-use cavity and generates a post-impingement fluid within the first re-use cavity, and wherein the at least one additional re-use cavity is arranged and disposed to receive the post-impingement fluid as a secondary impingement fluid flow through the plurality of apertures from the first re-use cavity such that the secondary impingement fluid flow impingement cools the suction side and the pressure side of the inner surface along the at least one additional re-use cavity and forms a secondary post-impingement fluid within the at least one additional re-use cavity, and the first re-use cavity and the at least one additional re-use cavity provides series impingement cooling of the inner surface of the article.

2. The article of claim 1, wherein the at least one up-pass cavity comprises a first up-pass cavity and a second up-pass cavity.

3. The article of claim 1, wherein each of the at least one up-pass cavities is arranged and disposed to receive fluid from outside the article.

4. The article of claim 1, further comprising an opening extending between the inner surface and the outer surface, the opening providing fluid flow through the body portion.

5. The article of claim 1, wherein the plurality of apertures are arranged and disposed to direct an increased amount of fluid towards the pressure side or the suction side of the article.

6. The article of claim 5, wherein directing the increased amount of fluid towards the pressure side of the article provides increased impingement cooling of the pressure side, and directing the increased amount of fluid towards the suction side of the article provides increased impingement cooling of the suction side.

7. The article of claim 1, wherein an amount of apertures formed in one of the plurality of partitions differs from an amount of apertures formed in at least one other partition.

8. The article of claim 7, wherein the amount of apertures formed in each of the plurality of partitions is selected to provide a desired film supply pressure.

9. The article of claim 7, wherein the amount of apertures formed in each of the plurality of partitions is selected to provide a desired wall temperature distribution.

10. The article of claim 1, wherein the plurality of partitions are integral with the body portion.

11. The article of claim 10, wherein the plurality of integral partitions are each connected to and integral with the pressure side of the inner surface of the body portion and the suction side of the inner surface of the body portion.

12. A method of cooling an article, the method comprising:

providing the article comprising:

a body portion having an inner surface and an outer surface, the inner surface defining an inner region;

an up-pass partition extending across the inner region, the up-pass partition forming an up-pass cavity within the inner region;

at least one re-use partition extending across the inner region, the at least one re-use partition forming a first re-use cavity and at least one additional re-use partition within the inner region; and a plurality of apertures formed in each of the up-pass partition and the at least one re-use partition, the plurality of apertures arranged and disposed to direct fluid toward the inner surface of the body portion;

directing a fluid into the up-pass cavity;

generating an impingement fluid flow through the plurality of apertures in the up-pass partition;

contacting a suction side and a pressure side of the inner surface of the body portion along the first re-use cavity with the impingement fluid flow, the contacting of the suction side and the pressure side of the inner surface along the first re-use cavity impingement cooling the suction side and the pressure side of the inner surface along the first re-use cavity and forming a post-impingement fluid within the first re-use cavity;

generating a secondary impingement fluid flow through the plurality of apertures in the at least one re-use partition; and contacting the suction side and the pressure side of the inner surface of the body portion along the at least one additional re-use partition with the secondary impingement fluid flow, the contacting of the suction side and the pressure side of the inner surface along the at least one additional re-use partition impingement cooling the suction side and the pressure side of the inner surface along the at least one additional re-use partition and forming a secondary post-impingement fluid within the at least one additional re-use cavity;

wherein contacting the suction side and the pressure side of the inner surface of the body portion along the first re-use cavity with the first impingement fluid flow and contacting the suction side and the pressure side of the inner surface of the body portion along the at least one additional re-use partition with the secondary impingement flow provides series impingement cooling of the inner surface of the article.

13. The method of claim 12, wherein the up-pass partition, the at least one re-use partition, and the at least one additional re-use partition are integral with the body portion.

14. The method of claim 13, wherein the up-pass partition, the at least one re-use partition, and the at least one additional re-use partition are each connected to and integral with the pressure side of the inner surface of the body portion and the suction side of the inner surface of the body portion.

15. An article, comprising:

a body portion having an inner surface and an outer surface, the inner surface defining an inner region;

a plurality of integral partitions within the body portion, wherein the plurality of integral partitions are each connected to and integral with a pressure side of the body portion and a suction side of the body portion, each of the integral partitions extending across the inner region; and a plurality of apertures in each of the plurality of integral partitions, the plurality of apertures arranged and disposed to direct fluid towards the inner surface of the body portion;

wherein the plurality of integral partitions includes:

an integral up-pass partition defining at least one up-pass cavity arranged and disposed to receive fluid from outside the article; and at least one integral re-use partition defining at least a first re-use cavity and at least one additional re-use cavity, wherein the first re-use cavity is arranged and disposed to receive the fluid as an impingement fluid flow through the plurality of apertures from the up-pass cavity such that the impingement fluid flow impingement cools the inner surface along the first re-use cavity and generates a post-impingement fluid within the first re-use cavity, and wherein the at least one additional re-use cavity is arranged and disposed to receive the post-impingement fluid as a secondary impingement fluid flow through the plurality of apertures from the first re-use cavity such that the secondary impingement fluid flow impingement cooling the inner surface along the at least one additional re-use cavity and generates a secondary post-impingement fluid within the at least one additional re-use cavity, and the first re-use cavity and the at least one additional re-use cavity provides series impingement cooling of the inner surface of the article.

* * * * *